US012656014B2

(12) United States Patent
Mischler et al.

(10) Patent No.: US 12,656,014 B2
(45) Date of Patent: Jun. 16, 2026

(54) METHOD OF OPERATING AN HVAC SYSTEM

(71) Applicant: BELIMO HOLDING AG, Hinwil (CH)

(72) Inventors: Stefan Mischler, Wald (CH); Ronald Aeberhard, Grüt (CH); Volkher Scholz, Zürich (CH)

(73) Assignee: BELIMO HOLDING AG, Hinwil (CH)

( * ) Notice: Subject to any disclaimer, the term of this patent is extended or adjusted under 35 U.S.C. 154(b) by 160 days.

(21) Appl. No.: 18/683,947

(22) PCT Filed: Aug. 22, 2022

(86) PCT No.: PCT/EP2022/073306
§ 371 (c)(1),
(2) Date: Feb. 15, 2024

(87) PCT Pub. No.: WO2023/030943
PCT Pub. Date: Mar. 9, 2023

(65) Prior Publication Data

US 2024/0353140 A1 Oct. 24, 2024

(30) Foreign Application Priority Data

Aug. 30, 2021 (CH) ..... 70219/2021

(51) Int. Cl.
*F24F 11/74* (2018.01)
*F24F 140/20* (2018.01)

(52) U.S. Cl.
CPC ..... *F24F 11/74* (2018.01); *F24F 2140/20* (2018.01); *F24F 2221/00* (2013.01)

(58) Field of Classification Search
CPC .. F24F 11/83; F24F 11/84; F24F 11/85; F24F 11/74; F24F 19/1015; F24F 2140/20
See application file for complete search history.

(56) References Cited

U.S. PATENT DOCUMENTS

2014/0222218 A1* 8/2014 D'silva ..... G05D 23/1931 700/276
2021/0180891 A1* 6/2021 Rousselet ..... F28D 5/00
(Continued)

FOREIGN PATENT DOCUMENTS

WO 2012/065275 A1 5/2012
WO 2019/238631 A1 12/2019
WO 2020/114668 A1 6/2020

OTHER PUBLICATIONS

Swiss Search Report for CH 702192021 dated Dec. 6, 2021.
(Continued)

*Primary Examiner* — Marc E Norman
(74) *Attorney, Agent, or Firm* — Sughrue Mion, PLLC

(57) ABSTRACT

A method of operating an HVAC system that includes a thermal energy source and a thermal energy transfer device, using a flow regulating device arranged to regulate a flow rate of a fluid between the thermal energy source and the thermal energy transfer device, the method including determining a supply temperature of the fluid, determining a return temperature of the fluid, determining the flow rate of the fluid, and regulating the flow rate of the fluid such as to maintain a target temperature difference between the supply temperature and the return temperature, while ensuring that the return temperature is above a minimum return temperature threshold and the flow rate is above an operational flow rate threshold of the thermal energy transfer device.

20 Claims, 6 Drawing Sheets

(56) References Cited

U.S. PATENT DOCUMENTS

2023/0349577 A1* 11/2023 Mischler ..... F24F 11/84
2023/0417443 A1* 12/2023 Fux ..... F24F 11/85

OTHER PUBLICATIONS

International Search Report for PCT/EP2022/073306 dated Nov. 22, 2022.
Written Opinion for PCT/EP2022/073306 dated Nov. 22, 2022.

* cited by examiner

METHOD OF OPERATING AN HVAC SYSTEM

CROSS REFERENCE TO RELATED APPLICATIONS

This application is a National Stage of International Application No. PCT/EP2022/073306 filed Aug. 22, 2022, claiming priority based on Swiss Patent Application No. 070219/2021 filed Aug. 30, 2021, the contents of each of which being herein incorporated by reference in their entireties.

FIELD OF THE INVENTION

The present invention relates to a method of operating an HVAC system comprising a thermal energy source and a thermal energy transfer device using a flow regulating device arranged to regulate a flow rate of a fluid between the thermal energy source and the thermal energy transfer device. The present invention further relates a flow regulating device. The present invention further relates to an HVAC system comprising a thermal energy source; a thermal energy transfer device; a fluid transportation system and a flow regulating device. The present invention even further relates to a computer program product for operating an HVAC system.

BACKGROUND OF THE INVENTION

As people spend an estimated 90% of their time indoors, Heating, Ventilating and Air Conditioning HVAC systems have become of great importance to everyday life and have a great impact on people's health and comfort. In the field of Heating, Ventilating and Air Conditioning, HVAC systems typically comprise a fluid transportation system connected to a heat exchanger arranged such as to be able to transfer thermal energy to or from the environment to be controlled (referred to hereafter as controlled environment) by means of a fluid circulating in said fluid transportation system.

Various thermal networks are known for enabling transfer of thermal energy from a (potentially shared) thermal energy source to one or more controlled environment(s), such as district heating, district cooling and low temperature networks. Alternatively, or additionally, thermal networks are known for enabling transfer of thermal energy from one or more controlled environment(s), whereby the controlled environment(s) act as an energy source, for example by capturing thermal energy as a by-product of an industrial process.

In thermal networks of the district heating type, the fluid circulating in the fluid transportation system is typically characterized by high supply temperatures (e.g. between 60 and 130° C.) from the thermal energy source, a thermal energy transfer device, such as a heat exchanger being arranged to decouple the district heating network from the thermal energy consumer (located or thermally coupled with the controlled environment).

In thermal networks of the district cooling type, the fluid circulating in the fluid transportation system is typically characterized by very low supply temperatures (e.g. between −1 and 7° C.) from the thermal energy source, a thermal energy transfer device, such as a heat exchanger being arranged to decouple the district cooling network from the thermal energy consumer (located or thermally coupled with the controlled environment).

In thermal networks of the low temperature network type, also referred to as $5^{th}$ generation district heating, the fluid circulating in the fluid transportation system is typically characterized by moderate supply temperatures (e.g. between 2 and 20° C.) from the thermal energy source, a thermal energy transfer device, such as a heat pump being arranged to decouple the low temperature network from the thermal energy consumer (located or thermally coupled with the controlled environment). Furthermore, the thermal energy transfer device, such as a heat pump, is arranged to supplement the thermal energy provided by the thermal energy source, transferring the moderate temperature of the network to a higher or a lower temperature which can be used for heating, respectively cooling. Low temperature networks often incorporate renewable energy sources (e.g. ground heat) and can be used for both heating and cooling of buildings. In such networks, heat pumps are often used for space heating and domestic hot water, whereas in some cases cooling can be supplied directly using heat exchangers only.

However, it has been observed that known methods/systems for operating HVAC systems comprising a thermal energy source and a thermal energy transfer device often operate suboptimally, unreliably and/or are prone to failures.

SUMMARY OF THE INVENTION

It is an object of embodiments disclosed herein to at least partially overcome the disadvantages of known methods/systems for operating HVAC systems comprising a thermal energy source and a thermal energy transfer device.

Applicant has observed that known methods/systems for operating HVAC systems comprising a thermal energy source and a thermal energy transfer device often operate sub-optimally, unreliably and/or are prone to failures due to one or more of the following:

- Frequent interruptions in the operation of the energy transfer device;
- Reduced temperature difference between supply and return temperature leading to unnecessarily high fluid flow, which results in wasted energy required to induce said flow and potentially, if energy is billed by amount of fluid flow, causes over-billing.
- System breakdowns.

Applicant has identified the cause of the above-mentioned issues as follows:

- Frequent interruptions in the operation of the energy transfer device are often caused by operation of the energy transfer device outside its operational flow rate threshold;
- Reduced temperature difference between supply and return temperature is often caused by the failure of known methods/systems to regulate the flow of the fluid such as to enable the heat transfer device to transfer a sufficiently high amount of heat (per unit of fluid) to/from the fluid that flows through the fluid transportation system between the thermal energy source and the energy transfer device.
- System breakdowns of known systems are often caused by freezing and/or condensation of the fluid in the energy transfer device and/or the fluid transportation system having the potential of causing significant damage.

Therefore, it is an object of embodiments disclosed herein to provide a method/system for operating HVAC systems comprising a thermal energy source and a thermal energy transfer device which enables optimal operation of the HVAC system, avoiding frequent interruptions in the operation of the energy transfer device; maximizing the transfer of thermal energy per unit of fluid flowing through the fluid transportation system; and avoiding breakdowns caused by freezing and/or condensation of the fluid in the energy transfer device and/or the fluid transportation system. According to the present disclosure, this object is achieved by the features of the independent claim 1. In addition, further advantageous embodiments follow from the dependent claims and the description.

In particular, the above-identified objectives are addressed according to the present disclosure by a method of operating an HVAC system using a flow regulating device arranged to regulate a flow rate of a fluid between a thermal energy source and a thermal energy transfer device.

According to embodiments disclosed herein, the fluid is a gaseous fluid, such as air and/or a liquid, such as water. The term thermal energy source is used in the context of the present invention to refer to a source of both heating and cooling energy source. Correspondingly, according to embodiments of the HVAC system, the thermal energy source is configured to supply heat to the thermal energy transfer device—referred to as heating. Alternatively, or additionally the thermal energy source is configured to extract heat from the thermal energy transfer device—referred to as cooling.

According to particular embodiments of the present disclosure, the thermal energy source is part of a thermal network such as a district heating/cooling or low temperature network, while the thermal energy transfer device is a heat exchanger. Alternatively or additionally, the thermal energy transfer device comprises a heat pump configured to supplement the thermal energy provided by the thermal energy source.

In a first step of the method, a supply temperature; a return temperature and a flow rate of the fluid are determined (continuously, pseudo-continuously and/or at intervals during operation of the HVAC system). According to embodiments of the present disclosure, the supply temperature; the return temperature and/or the flow rate of the fluid are measured in a supply fluid transportation line and/or a return fluid transportation line of the fluid transportation system connecting the thermal energy source and the thermal energy transfer device. Alternatively, or additionally, the supply temperature is determined based on a measurement of the return temperature and data indicative of the relationship between the supply temperature and the return temperature as a function of the flow rate. Alternatively, or additionally, the return temperature is determined based on a measurement of the supply temperature and data indicative of the relationship between the supply temperature and the return temperature as a function of the flow rate.

Based on the determined supply temperature; return temperature and flow rate of the fluid, the flow rate of the fluid is regulated such as to maintain a target temperature difference between the supply temperature and the return temperature. According to embodiments of the present disclosure, regulating the flow rate of the fluid such as to maintain a target temperature difference comprises:

- Maintaining a target temperature difference as a function of the supply temperature, advantageous as it enables accounting for different levels of supply temperatures. Compared to a fixed temperature difference, a target temperature difference as a function of the supply temperature enables increased efficiency and ensures the system is also optimized in part load.
- Maximizing the temperature difference, advantageous in particular in HVAC systems wherein minimizing the flow of the fluid is desired, e.g. when the fluid needs to be conveyed over long distances/great differences in elevation and/or in case billing of energy costs is based on volume of supplied fluid.
- Maintain a predefined return temperature range, advantageous in particular in HVAC systems where the return temperature should not exceed a set threshold (in addition to ensuring that it is above a minimum return temperature threshold—see below).

The flow rate of the fluid is regulated such as to maintain a target temperature difference while ensuring that the return temperature is above a minimum return temperature threshold and that the flow rate is above an operational flow rate threshold of the thermal energy transfer device. Adherence to these two criteria addresses the aim to ensure that the HVAC system operates optimally, with less interruptions and less prone to errors. Ensuring that the return temperature is above a minimum return temperature threshold avoids the thermal energy transfer device and/or the fluid transportation system from being damaged due to freezing and/or condensation of the fluid. Ensuring that the flow rate is above an operational flow rate threshold of the thermal energy transfer device helps avoid unnecessary interruptions in the operation of the HVAC system due to the thermal energy transfer device being forced to shut down due to insufficient flow rate. Furthermore, ensuring that the flow rate is above an operational flow rate threshold of the thermal energy transfer device prevents unnecessary wear of the thermal energy transfer device due to operation near or below optimum parameters.

According to embodiments of the present disclosure, in order to prevent the return temperature from dropping below the minimum return temperature threshold, the method further comprises increasing the flow rate if the return temperature is equal to or less than the sum of the minimum return temperature threshold and a temperature safety margin. If, despite the flow regulating device being fully open, the return temperature is equal to or less than the sum of the minimum return temperature threshold and the temperature safety margin, according to embodiments of the present disclosure, the flow regulating device is closed off, preventing the flow of fluid to and/or from the thermal energy source. The flow regulating device is closed off to avoid damage due to the return temperature dropping below the minimum return temperature threshold. Alternatively, or additionally, the flow regulating device is closed off, if the flow rate is equal to or less than the sum of the operational flow rate threshold and the flow safety margin despite the flow regulating device being fully open. According to further embodiments disclosed herein, the flow regulating device is closed off upon detection of a sudden change of the return temperature, a sudden change of the return temperature being indicative of a malfunction and/or deactivation of the thermal energy transfer device. Hence, the method/system of the present disclosure is able to react to unforeseen events, such as a malfunction of the thermal energy transfer device. The terms fully open and closed off as used herein with respect to the flow regulating device also comprise the flow regulating device being set to a (defined) maximum flow rate and a minimum flow rate respectively.

Alternatively, or additionally, if the flow regulating device is fully open and the return temperature is equal to or less than the sum of the minimum return temperature threshold and the temperature safety margin, the flow regulating device is communicatively connected to the thermal energy transfer device to transmit a turn-off signal to the thermal energy transfer device to avoid damage due to risk of the return temperature dropping below the minimum return temperature threshold.

Alternatively, or additionally, if the flow regulating device is fully open and the flow rate is equal to or less than the sum of the operational flow rate threshold and the flow safety margin, the flow regulating device transmits a turn-off signal to the thermal energy transfer device to avoid damage due to risk of the flow rate below the operational flow rate threshold. In order to avoid unnecessary flow through the system, the flow regulating device is closed off after the thermal energy transfer device has been turned off.

To avoid the flow rate dropping below the operational flow rate threshold, operating the HVAC system according to embodiments of the present disclosure further comprises increasing the flow rate if the flow rate is equal to or less than the sum of the operational flow rate threshold and a flow safety margin.

According to further embodiments of the present disclosure, the flow regulating device is communicatively connected to the thermal energy transfer device to receive a signal indicative of a thermal energy demand thereof. In order to operate the HVAC system even more efficiently, the flow rate is regulated further as a function of the thermal energy demand. In particular, increasing the flow rate at predetermined time interval(s), in the presence of thermal energy demand—while maintaining the target temperature difference and ensuring that the return temperature is above a minimum return temperature threshold. Hence, if the flow rate has been previously reduced or if the flow regulating device has been previously closed off, the flow regulating device makes successive attempts to meet the energy demand (in the presence of an energy demand)—while meeting the safe conditions of minimum return temperature threshold and operational flow rate threshold. According to further embodiments, a time interval between successive attempts to meet the energy demand (by increasing the flow-rate) is gradually increased after each attempt, the time interval being reset to an initial value after a successful attempt.

It is an object of further embodiments of the present disclosure to operate the HVAC system in accordance with a secondary fluid circuit, that is the fluid circuit connecting the thermal energy transfer device with the thermal energy consumer. This further object is addressed by receiving, by the flow regulating device, data indicative of a secondary supply temperature and/or a secondary return temperature of a secondary fluid flowing between the thermal energy transfer device and the thermal energy consumer and regulating the flow rate of the fluid further as a function of the secondary supply temperature and/or the secondary return temperature. Alternatively, or additionally, this further object is addressed by receiving, by the flow regulating device, data indicative of an energy consumption of the thermal energy transfer device and regulating the flow rate of the fluid further as a function of the energy consumption of the thermal energy transfer device.

It is an object of further embodiments of the present disclosure to operate the HVAC system in accordance with the functioning of the thermal energy transfer device, in particular if the thermal energy transfer device is configured to supplement the thermal energy provided by the thermal energy source. This further object is addressed by receiving, by the flow regulating device, data indicative of internal state(s) of the thermal energy transfer device and regulating the flow rate of the fluid further as a function of the internal state(s) of the thermal energy transfer device and/or the thermal energy demand.

It is a further object of the present disclosure to provide a flow regulating valve which, if arranged to regulate a flow rate of a fluid between a thermal energy source and a thermal energy transfer device of an HVAC system, enable the operation of the HVAC system avoiding frequent interruptions in the operation of the energy transfer device; maximizing the transfer of thermal energy to/from per unit of fluid flowing through the fluid transportation system; and avoiding breakdowns caused by freezing of the fluid in the energy transfer device and/or the fluid transportation system. According to the present disclosure, this further object is achieved by the features of the independent claim 11. In addition, further advantageous embodiments follow from the dependent claims and the description. In particular, this object is addressed by a flow regulating device comprising a valve and/or a damper configured to regulate a flow rate of a fluid between a thermal energy source and a thermal energy transfer device, the flow regulating device further comprising a processing unit configured to carry out the method according to one of the embodiments disclosed herein. Alternatively, or additionally, the flow regulating device comprises a pump (in case the fluid is a liquid) and/or a fan (in case the fluid is a gas) configured to regulate a flow rate of a fluid between a thermal energy source and a thermal energy transfer device.

According to embodiments of the present disclosure, the flow regulating device comprises a flow rate sensor device configured to determining the flow rate of the fluid to and/or from the thermal energy source and the thermal energy transfer device and a temperature sensor device configured to determine a supply temperature of the fluid and a return temperature of the fluid. According to embodiments of the flow regulating device, the temperature sensor device comprises a first temperature sensor configured to determine the supply temperature of the fluid to the thermal energy source and a second temperature sensor configured to determine the return temperature of the fluid from the thermal energy source. Alternatively, or additionally, the supply temperature is determined by the temperature sensor device based on a measurement of the return temperature by the second temperature sensor and data indicative of the relationship between the supply temperature and the return temperature as a function of the flow rate. Alternatively, or additionally, the return temperature is determined by the temperature sensor device based on a measurement of the supply temperature by the first temperature sensor and data indicative of the relationship between the supply temperature and the return temperature as a function of the flow rate.

In order to allow operation of the HVAC system in view of the energy demand of the thermal energy transfer device, according to embodiments, the flow regulating device further comprises (or is communicatively connected to) a secondary temperature sensor device configured to determine a secondary supply temperature and/or a secondary return temperature of a secondary fluid at a secondary fluid circuit of the thermal energy consumer, the flow regulating device being further configured to determine a thermal energy demand of the thermal energy transfer device based on the secondary supply temperature and/or the secondary return temperature. Alternatively, or additionally the flow regulating device comprises (or is communicatively connected to) a secondary flow rate sensor device configured to determine a secondary flow rate of the secondary fluid at the secondary fluid circuit of the thermal energy consumer, the flow regulating device being further configured to determine a thermal energy demand of the thermal energy transfer device based on the secondary flow rate.

It is a further object of the present disclosure to provide an HVAC system enabled to operate such as to avoid frequent interruptions in the operation of the energy transfer device; maximize the transfer of thermal energy per unit of fluid flowing through the fluid transportation system; and avoid breakdowns caused by freezing of the fluid in the energy transfer device and/or the fluid transportation system. According to the present disclosure, this further object is achieved by the features of the independent claim 16. In addition, further advantageous embodiments follow from the dependent claims and the description. In particular, this object is addressed by an HVAC system comprising a thermal energy source; a thermal energy transfer device; a fluid transportation system comprising a supply fluid transportation line arranged to transport a fluid from the thermal energy source to the thermal energy transfer device and a return fluid transportation line arranged to transport the fluid from the thermal energy transfer device to the thermal energy source. The HVAC system further comprising a flow regulating device according to one of the embodiments disclosed herein.

Embodiments of the HVAC system further comprise a thermal energy consumer, such as a heat exchanger, connected to the thermal energy transfer device 200 by a secondary supply fluid transportation line and a secondary return fluid transportation line of a secondary fluid transportation system for transporting a secondary fluid.

According to embodiments of the HVAC system, the thermal energy source is configured to supply heat to the thermal energy transfer device—referred to as heating. Alternatively, or additionally the thermal energy source is configured to extract heat from the thermal energy transfer device—referred to as cooling.

According to embodiments of the HVAC system, the thermal energy transfer device comprises a secondary thermal energy source configured to supplement the thermal energy provided by the thermal energy source, such as a heat pump, a combustion heater, an electric heater or chiller.

It is a further object of the present disclosure to provide a computer program product, comprising instructions, which—when executed by a processing unit of a flow regulating device enable the operation of an HVAC system such as to avoid frequent interruptions in the operation of the energy transfer device; maximize the transfer of thermal energy per unit of fluid flowing through the fluid transportation system; and avoid breakdowns caused by freezing of the fluid in the energy transfer device and/or the fluid transportation system. According to the present disclosure, this object is achieved by the features of the independent claim 20. In addition, further advantageous embodiments follow from the dependent claims and the description. In particular, this further object is addressed by a computer program product comprising instructions, which—when executed by a processing unit of a flow regulating device, cause the flow regulating device to carry out the method of operating an HVAC system according to one of the embodiments disclosed herein.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

BRIEF DESCRIPTION OF THE DRAWINGS

The herein described disclosure will be more fully understood from the detailed description given herein below and the accompanying drawings which should not be considered limiting to the disclosure described in the appended claims. The drawings which show:

DETAILED DESCRIPTION

Reference will now be made in detail to certain embodiments, examples of which are illustrated in the accompanying drawings, in which some, but not all features are shown. Indeed, embodiments disclosed herein may be embodied in many different forms and should not be construed as limited to the embodiments set forth herein; rather, these embodiments are provided so that this disclosure will satisfy applicable legal requirements. Whenever possible, like reference numbers will be used to refer to like components or parts.

Figure 1:
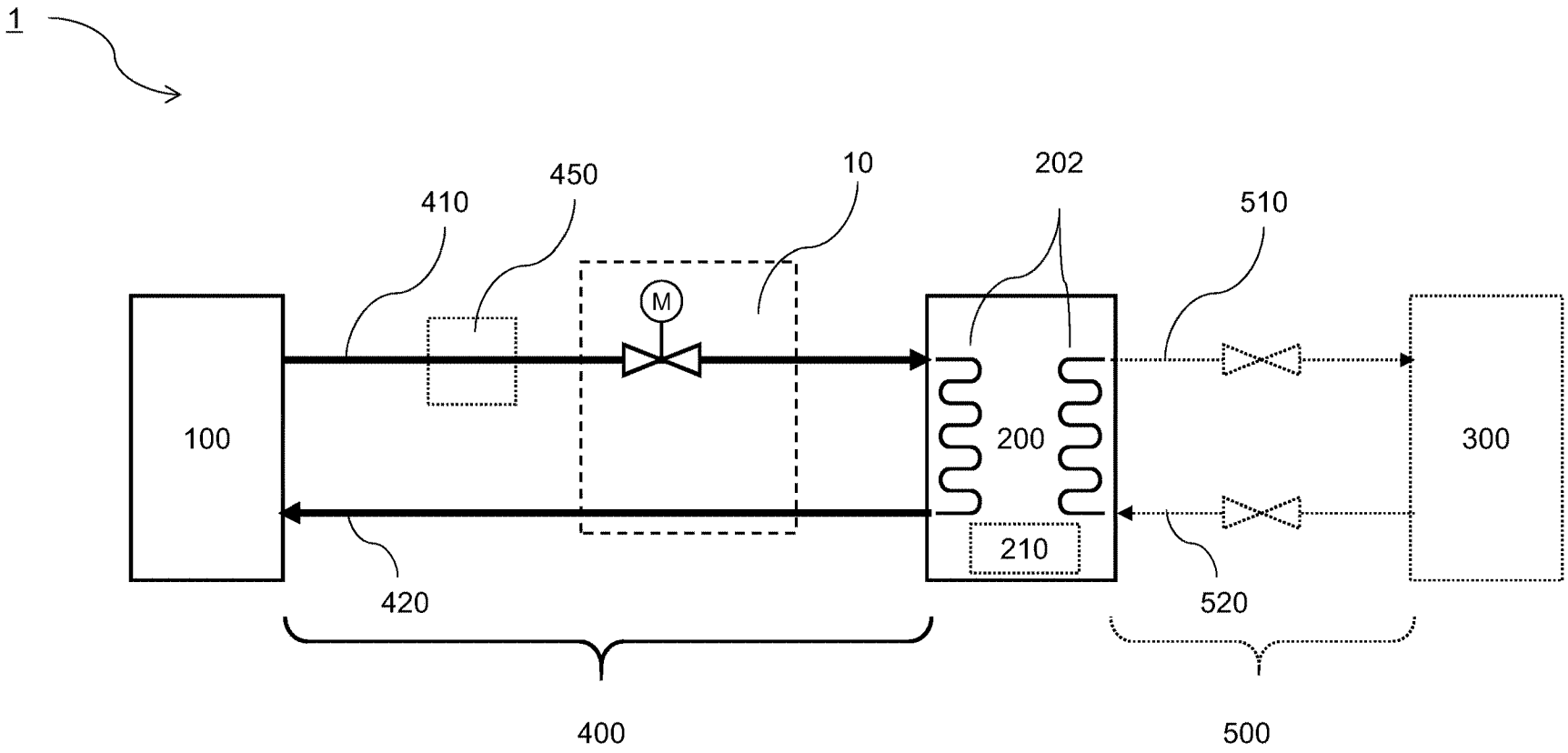
FIG. 1: a highly schematic block diagram of an embodiment of the HVAC system according to the present disclosure.

FIG. 1 shows a highly schematic block diagram of an embodiment of the HVAC system 1 according to the present disclosure, comprising a thermal energy source 100 and a thermal energy transfer device 200 connected by a fluid transportation system 400. The fluid transportation system 400 comprises a supply fluid transportation line 410 arranged to transport a fluid from the thermal energy source 100 to the thermal energy transfer device 200 and a return fluid transportation line 420 arranged to transport the fluid from the thermal energy transfer device 200 to the thermal energy source 100. A pump/fan 450 may be provided to induce the flow of fluid through the fluid transportation system 400

The thermal energy source 100 is configured to supply heating and cooling energy to the thermal energy transfer device 200 such as to supply/extract heat to/from the thermal energy transfer device 200. The thermal energy (heating/cooling) is supplied/extracted by means of the fluid flowing through the fluid transportation system 400.

According to particular embodiments—illustrated on FIG. 1 with dotted lines—the HVAC system 1 comprises a secondary fluid transportation system 500, fluidly connecting the thermal energy transfer device 200 with an energy consumer 300. The secondary fluid transportation system 500 comprises a secondary supply fluid transportation line 510 and a secondary return fluid transportation line 520 for transporting a secondary fluid between the thermal energy transfer device 200 and the thermal energy consumer 300.

In order to transfer thermal energy (heating/cooling) between the fluid transportation system 400 and the secondary fluid transportation system 500, the thermal energy transfer device 200 comprises a heat exchanger 202, connected to both the fluid transportation system 400 and the secondary fluid transportation system 500 such as to enable thermal transfer therebetween.

Additionally or alternatively, the thermal energy transfer device 200 comprises a secondary thermal energy source 210 such as a heat pump, a combustion heater, an electric heater or chiller or a combination thereof, configured to supplement the thermal energy provided by the thermal energy source 100.

Figure 2:
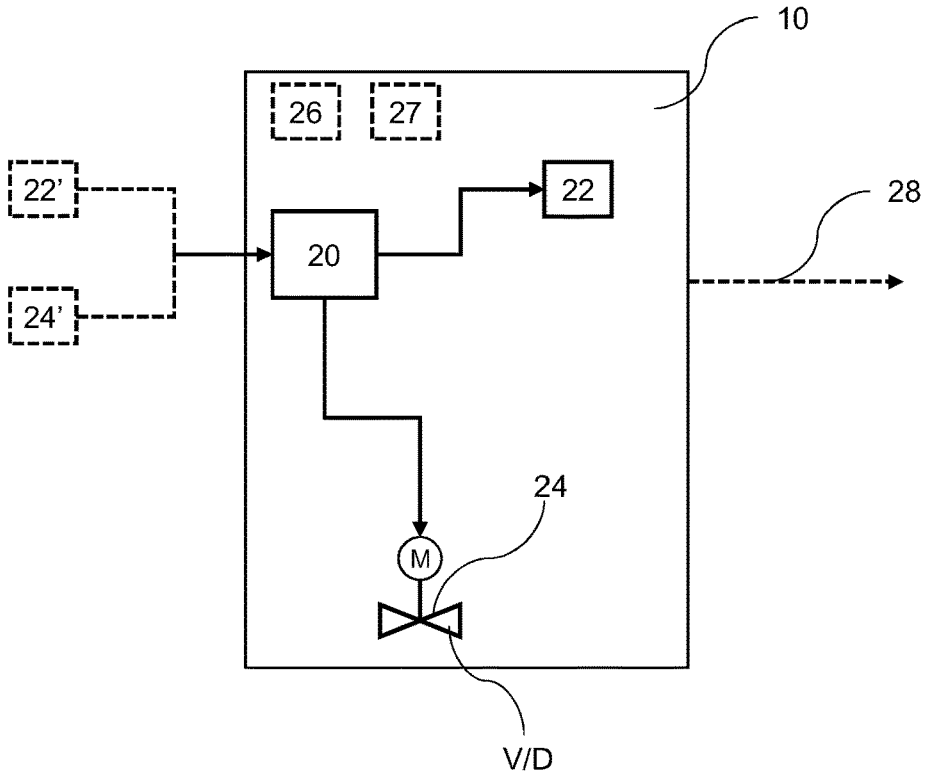
FIG. 2: a highly schematic block diagram of an embodiment of the flow regulating device according to the present disclosure.

FIG. 2 shows a highly schematic block diagram of an embodiment of the flow regulating device 10 according to the present disclosure. The flow regulating device 10 comprises a valve V and/or a damper D configured to regulate the flow rate Φ of the fluid between the thermal energy source 100 and the thermal energy transfer device 200 through the supply fluid transportation line 410 and return fluid transportation line 420 of the fluid transportation system 400. A motor M, in particular an electric motor, is provided to drive the valve V and/or a damper D.

The flow regulating device 10 further comprises a processing unit 20 configured to operate the HVAC system 1 according to any one of the embodiments of the method disclosed herein. Depending on the embodiment, the processing unit 20 comprises an electronic circuit implemented as programmed processors, including data and program memory, or another programmable logic unit, e.g. an application specific integrated circuit (ASIC).

Optionally, the flow regulating device 10 further comprises a communication module 26 configured for data communication with a remote computer or external controller, such as a Building Management System BMS. According to embodiments, the communication module of the flow regulating device 10 comprises a radio communication circuit, in particular a Wireless Local Area Network WLAN communication circuit; a Near Field Communication NFC, Ultra Wide Band UWB and/or a Bluetooth Low Energy BLE. According to further embodiments, the communication module of the flow regulating device 10 comprises a wired communication circuit, in particular an Ethernet communication circuit a BACnet, a ModBus and/or an MP-Bus communication circuit.

Optionally, the flow regulating device 10 further comprises a data store 27 for storing data content comprising configuration data of the flow regulating device 10, and for operationrelated data recorded by the flow regulating device 10.

The flow regulating device 10, in particular its processing unit 20, motor M, and sensor device(s) 22, 24, is powered by a power supply comprising a power connector and/or an internal energy storage device, such as battery and/or a capacitor. According to particular embodiments, the power connector is connected to the wired communication circuit, the flow regulating device 10 being powered by a data line connection, such as Power over Ethernet POE or Power over Data Line PODL.

The flow regulating device comprises a flow rate sensor device 24 configured to determining the flow rate Φ of the fluid to and/or from the thermal energy source 100 and the thermal energy transfer device 200 and a temperature sensor device 22 configured to determine a supply temperature Ts of the fluid and a return temperature Tr of the fluid.

In order to allow operation of the HVAC system 1 in view of the energy demand of the thermal energy transfer device 200, the flow regulating device 10 is communicatively connected to a secondary temperature sensor device 22' configured to determine a secondary supply temperature Ts2 and/or a secondary return temperature Tr2 of the secondary fluid transportation system 500 connecting the thermal energy consumer 300. Furthermore, the flow regulating device 10 is optionally communicatively connected to a secondary flow rate sensor device 24' configured to determine a secondary flow rate Φ2 of the secondary fluid at the secondary fluid transportation system 500.

Optionally, according to further embodiments, the flow regulating device 10 is communicatively connected to the thermal energy transfer device 200 using a corresponding interface 28 to receive a signal indicative of a thermal energy demand thereof.

Figure 3:
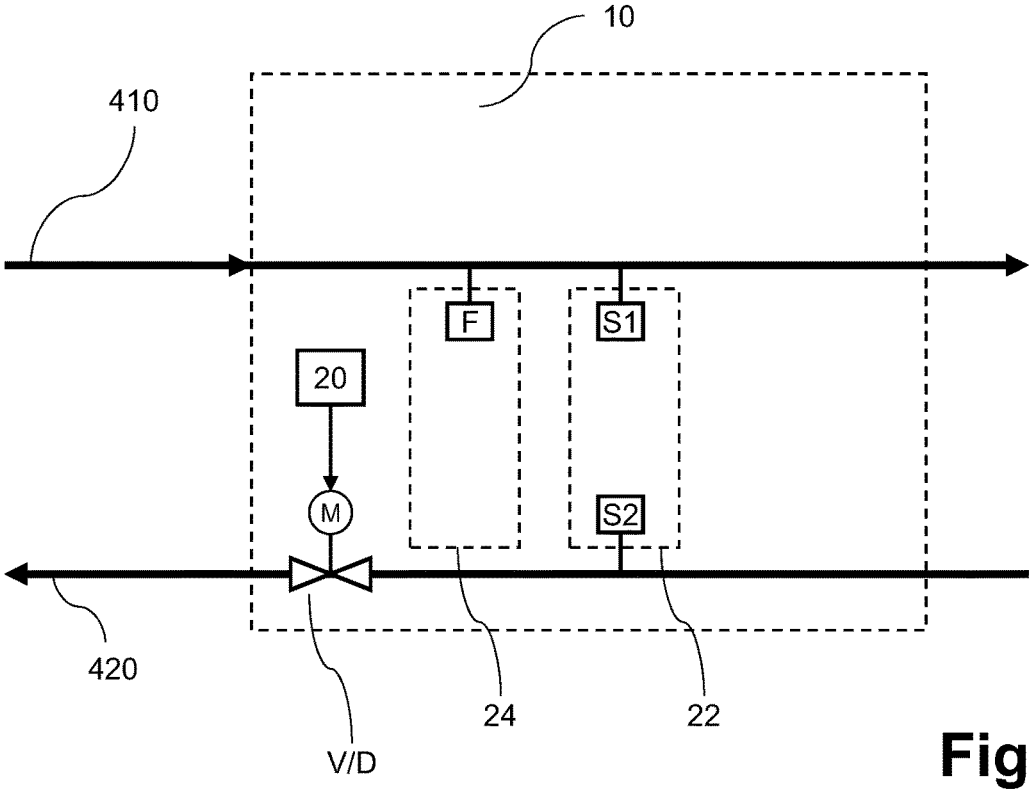
FIG. 3: a highly schematic diagram of an embodiment of the flow regulating device according to the present disclosure, illustrating the installation of the flow regulating device in the fluid transportation system between the thermal energy source and the thermal energy transfer device.

FIG. 3 shows a highly schematic diagram of an embodiment of the flow regulating device 10, illustrating the installation of the flow regulating device 10 in the fluid transportation system 400 between the thermal energy source 100 and the thermal energy transfer device 200. As shown on this figure, the valve V/damper D of the flow regulating device 10 is arranged on the return fluid transportation line 420 of the fluid transportation system 400. The temperature sensor device 22 comprises a first temperature sensor S1 configured to determine the supply temperature Ts of the fluid to the thermal energy source 100 and a second temperature sensor S2 configured to determine the return temperature Tr of the fluid from the thermal energy source 100.

According to various embodiments, the flow regulating device 10 may be arranged within a single housing or distributed amongst various housings. In particular, the sensor devices (flow rate sensor device 24, secondary flow rate sensor device 24', the temperature sensor device 22 and/or the secondary temperature sensor device 22') may be arranged in housings separate from the housing accommodating the processing unit 20, the communication module 26, the data store 27 and/or the interface to thermal energy transfer device 28.

Turning now to FIGS. 4 to 7, embodiments of the method of operating the HVAC system 1 shall be described in detail.

Figure 4:
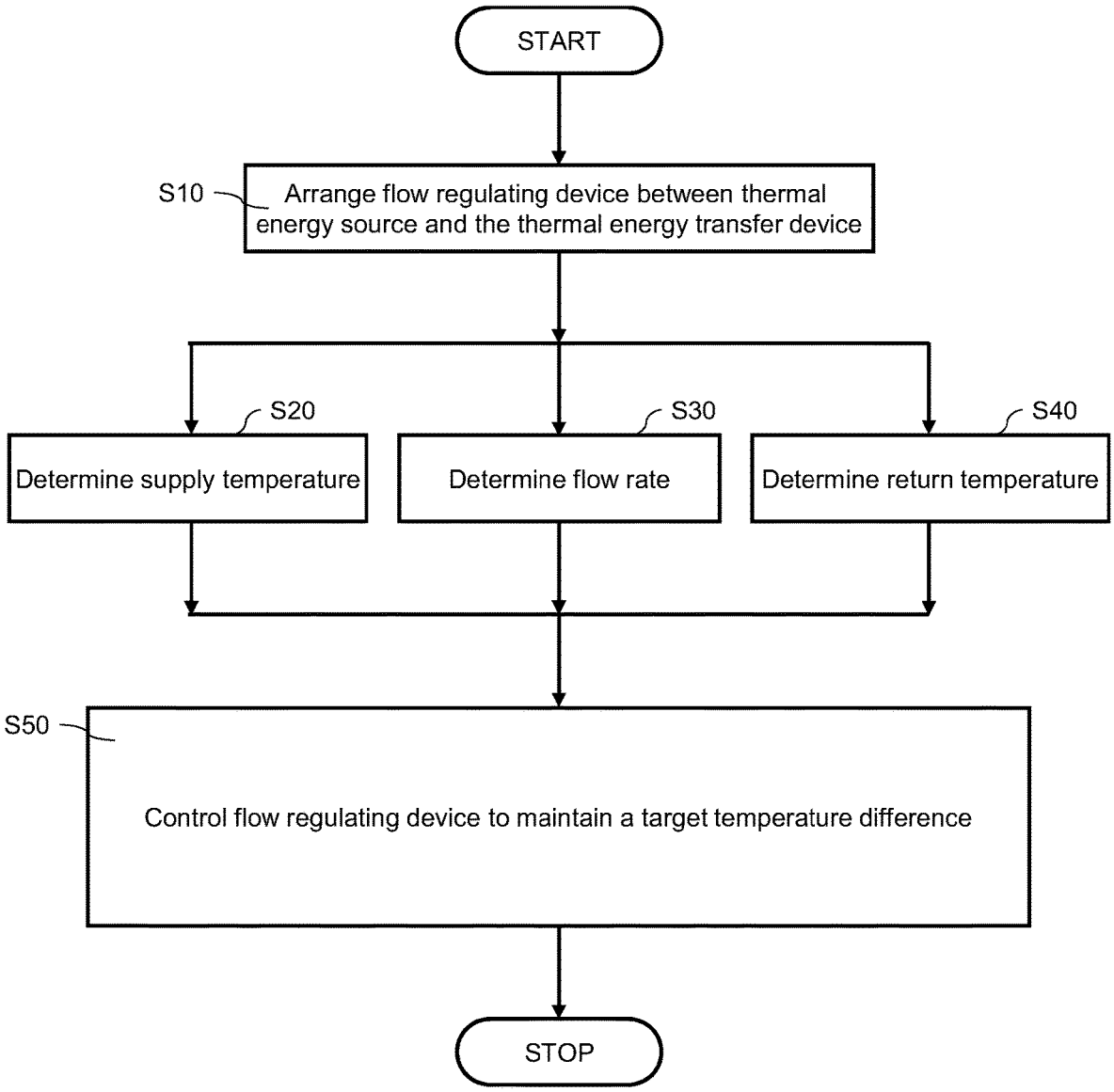
FIG. 4: a flowchart illustrating steps of an embodiment of the method of operating an HVAC system according to the present disclosure.

FIG. 4 shows a flowchart illustrating steps of an embodiment of the method of operating an HVAC system 1 comprising a thermal energy source 100 and a thermal energy transfer device 200. In a first, preparatory step S10, a flow regulating device 10 is arranged between the thermal energy source 100 and the thermal energy transfer device 200 such as to be able to regulate a flow rate Φ of a fluid between the thermal energy source 100 and the thermal energy transfer device 200. According to various embodiments, the flow regulating device 10 regulates the flow rate Φ of the fluid using a valve V/damper D arranged in the supply fluid transportation line 410 and/or the return fluid transportation line 420 of the fluid transportation system 400 connecting the thermal energy source 100 and the thermal energy transfer device 200.

Thereafter, in steps S20, S30 and S40, supply temperature Ts; return temperature Tr respectively flow rate Φ of the fluid are determined (continuously, pseudo-continuously and/or at intervals during operation of the HVAC system).

Based on the determined supply temperature Ts; return temperature Tr and flow rate Φ of the fluid, in step S50, the flow rate (Φ) of the fluid is controlled such as to maintain a target temperature difference dTt between the supply temperature Ts and the return temperature Tr.

According to embodiments of the present disclosure, regulating the flow rate (Φ) of the fluid such as to maintain a target temperature difference dTt comprises:

- Maintaining a target temperature difference dTt as a function of the supply temperature Ts, advantageous in particular in HVAC systems 1 having non-linear thermal energy transfer characteristics.
- Maximizing the temperature difference dT, advantageous in particular in HVAC systems 1 wherein minimizing the flow of the fluid is desired, e.g. when the fluid needs to be conveyed over long distances/great differences in elevation and/or in case billing of energy costs is based on volume of supplied fluid.
- Maintain a predefined return temperature range, advantageous in particular in HVAC systems 1 where the return temperature should not exceed a set threshold (in addition to ensuring that it is above a minimum return temperature threshold—see below).

Figure 5:
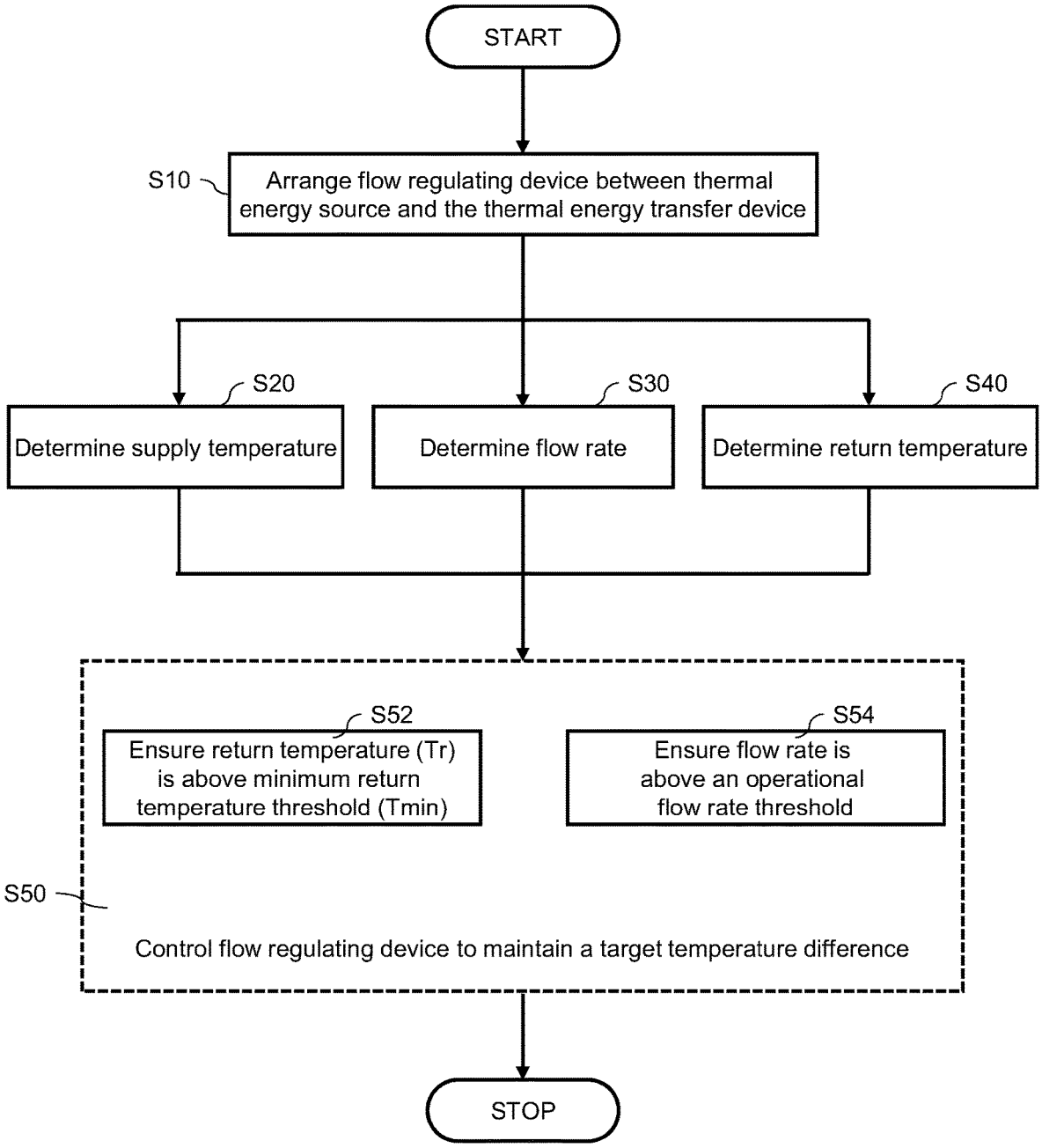
FIG. 5: a flowchart of an embodiment of the method of operating an HVAC system according to the present disclosure, showing substeps of regulating the flow rate of the fluid to maintain a target temperature difference between the supply and return temperatures to/from the thermal energy transfer device.

As shown on the flowchart of FIG. 5, the flow rate (Φ) of the fluid is regulated such as to maintain a target temperature difference dTt while ensuring—in substep S52 that the return temperature Tr is above a minimum return temperature threshold Trmin and ensuring—in substep S54—that the flow rate Φ is above an operational flow rate threshold Φmin of the thermal energy transfer device 200. Adherence to these two criteria addresses the aim to ensure that the HVAC system 1 operates optimally, with less interruptions and less prone to errors. Ensuring that the return temperature Tr is above a minimum return temperature threshold Trmin avoids the thermal energy transfer device 200 and/or the fluid transportation system 400 from being damaged due to freezing and/or condensation of the fluid. Ensuring that the flow rate Φ is above an operational flow rate threshold Φmin of the thermal energy transfer device 200 helps avoid unnecessary interruptions in the operation of the HVAC system 1 due to the thermal energy transfer device 200 being forced to shut down due to insufficient flow rate. Furthermore, ensuring that the flow rate Φ is above an operational flow rate threshold Φmin of the thermal energy transfer device 200 prevents unnecessary wear of the thermal energy transfer device 200 due to operation near or below its optimum parameters.

Figure 6:
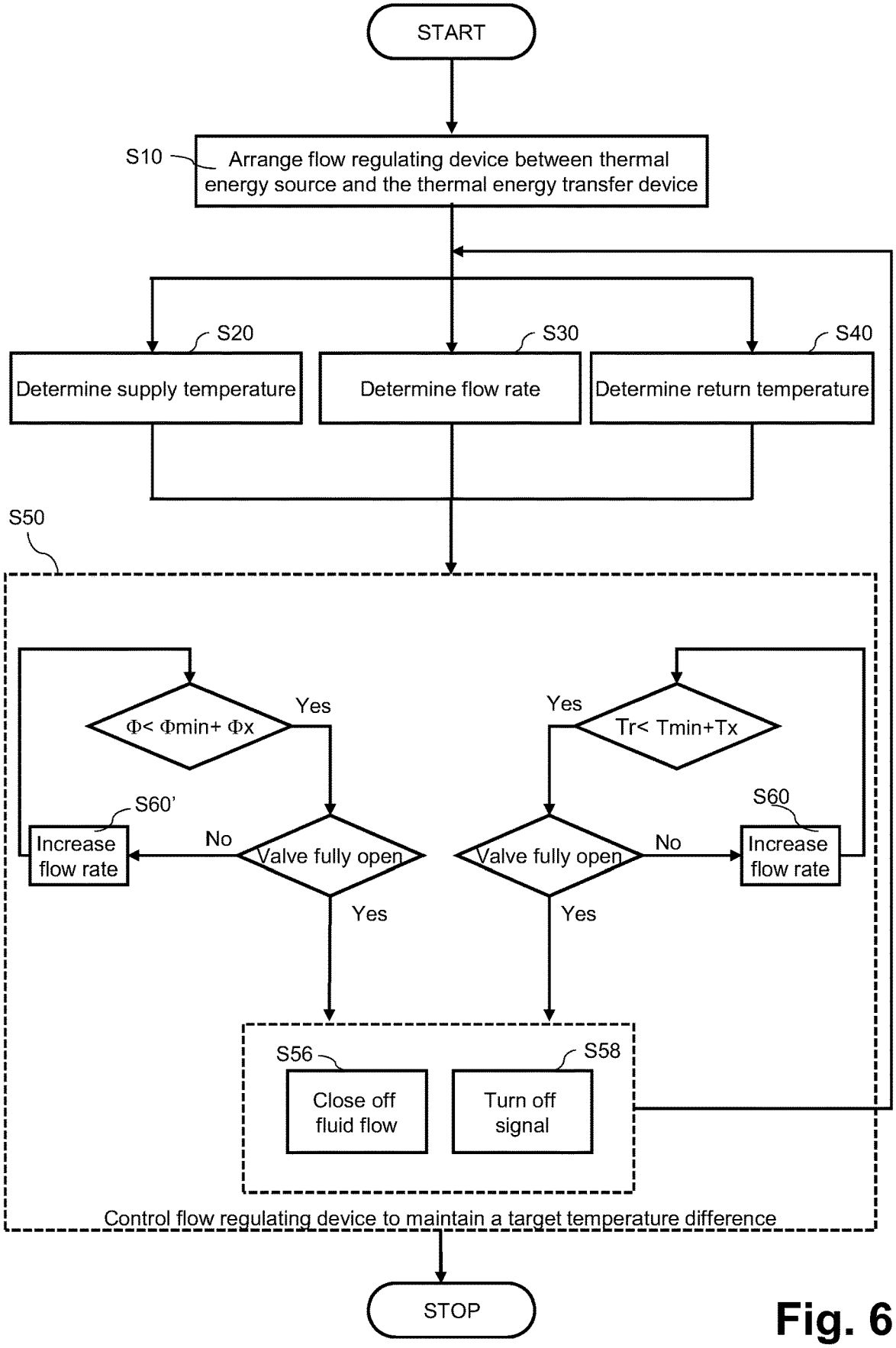
FIG. 6: a flowchart of an embodiment of the method of operating an HVAC system according to the present disclosure, showing substeps of a further embodiment of regulating the flow rate of the fluid to maintain a target temperature difference between the supply and return temperatures to/from the thermal energy transfer device.

As illustrated on the flowchart of FIG. 6, in order to prevent the return temperature Tr from dropping below the minimum return temperature threshold Trmin, the method further comprises—in a step S60—increasing the flow rate Φ if the return temperature Tr is equal to or less than the sum of the minimum return temperature threshold Trmin and a temperature safety margin Tx. If, despite the flow regulating device 10 being fully open, the return temperature Tr is equal to or less than the sum of the minimum return temperature threshold Trmin and the temperature safety margin Tx, in a step S56, the flow regulating device 10 is closed off, preventing the flow of fluid to and/or from the thermal energy source 100. The flow regulating device 10 is closed off to avoid damage due to the return temperature Tr dropping below the minimum return temperature threshold Trmin. Furthermore, the flow regulating device 10 is closed off, if the flow rate Φ is equal to or less than the sum of the operational flow rate threshold Φmin and the flow safety margin Φx despite the flow regulating device 10 being fully open.

Furthermore, if the flow regulating device 10 is fully open and the return temperature Tr is equal to or less than the sum of the minimum return temperature threshold Trmin and the temperature safety margin Tx, in step S58, the flow regulating device 10 transmits a turn-off signal to the thermal energy transfer device 200 to avoid damage due to risk of the return temperature Tr dropping below the minimum return temperature threshold Trmin.

To avoid the flow rate Φ dropping below the operational flow rate threshold Φmin, in step S60', the flow rate Φ is also increased if the flow rate Φ is equal to or less than the sum of the operational flow rate threshold Φmin and a flow safety margin Φx. Correspondingly, to avoid damage due to risk of the flow rate Φ below the operational flow rate threshold Φmin, the flow regulating device 10 also transmits—in step S58—a turn-off signal to the thermal energy transfer device 200 if the flow regulating device 10 is fully open and the flow rate Φ is equal to or less than the sum of the operational flow rate threshold Φmin and the flow safety margin Φx.

Figure 7:
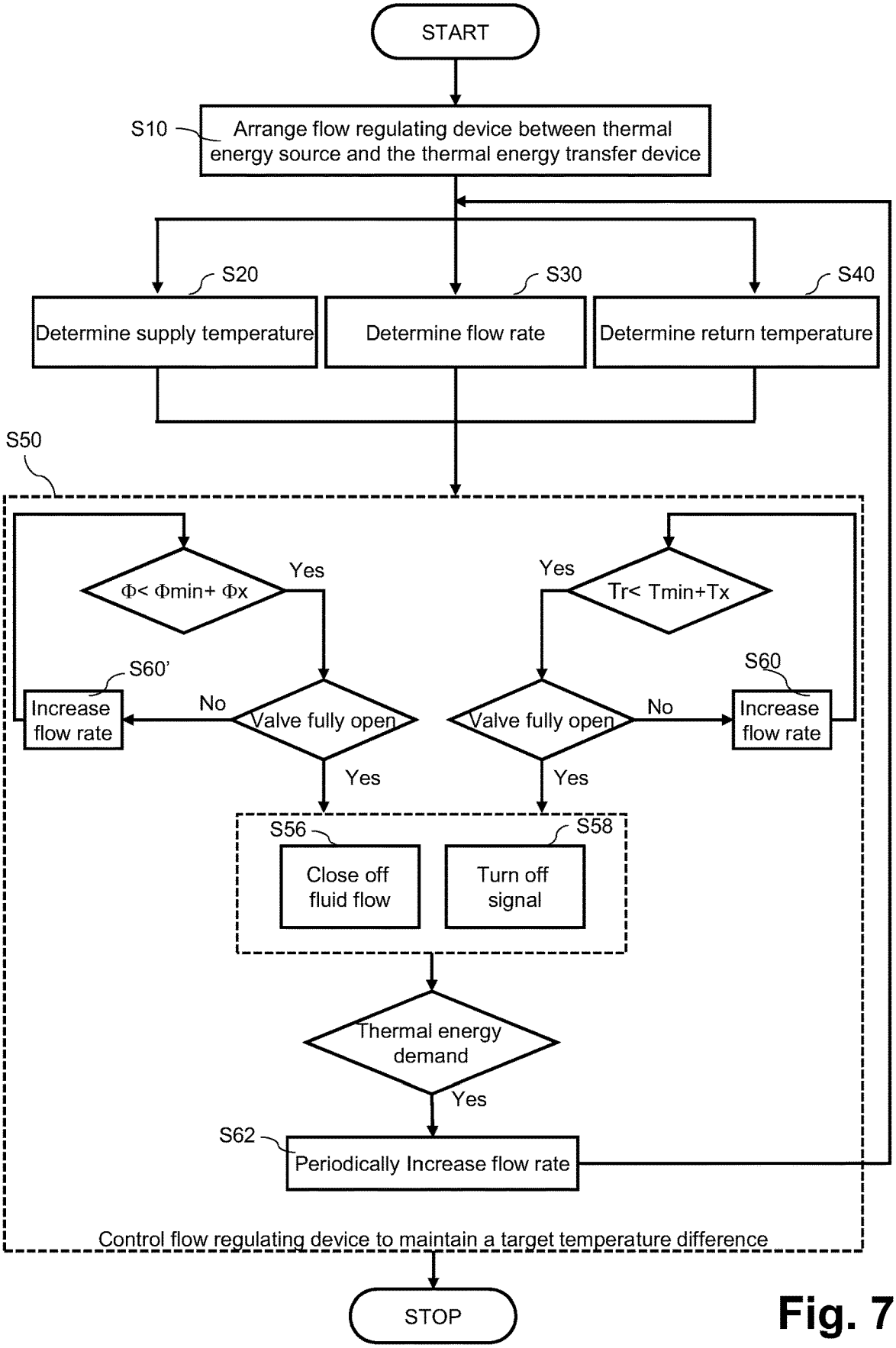
FIG. 7: a flowchart of an embodiment of the method of operating an HVAC system according to the present disclosure, showing substeps of a further embodiment of regulating the flow rate of the fluid to maintain a target temperature difference between the supply and return temperatures to/from the thermal energy transfer device.

As shown on the flowchart of FIG. 7, in order to allow the HVAC system 1 to be operated further as a function of a demand of thermal energy and hence to operate the HVAC system 1 even more efficiently, in step S62, the flow rate Φ is increased at predetermined time interval(s) dt in the presence of thermal energy demand. Hence, if the flow rate Φ has been previously reduced (e.g. to ensure a safe return temperature) or if the flow regulating device 10 has been previously closed off, the flow regulating device 10 makes successive attempts to meet the energy demand—while meeting the safe conditions of minimum return temperature threshold Trmin and operational flow rate threshold Φmin.

LIST OF REFERENCE NUMERALS

HVAC system 1
flow regulating device 10
temperature sensor device 22
secondary temperature sensor device 22'
flow rate sensor device 24
secondary flow rate sensor device 24'
communication module 26
data store 27
interface to thermal energy transfer device 28
thermal energy source 100
thermal energy transfer device 200
heat exchanger 202
secondary thermal energy source 210
thermal energy consumer 300
fluid transportation system 400
pump/fan 450
supply fluid transportation line 410
return fluid transportation line 420
secondary fluid transportation system 500
secondary supply fluid transportation line 510 secondary return fluid transportation line 520
flow rate Φ
secondary flow rate Φ2
operational flow rate threshold Φmin
flow safety margin
supply temperature Ts
secondary supply temperature T2*s*
secondary return temperature T2*r*
return temperature Tr
target temperature difference dTt
minimum return temperature threshold Trmin
temperature safety margin Tx
secondary supply temperature Ts
secondary return temperature Tr

The invention claimed is:

1. A method of operating an HVAC system that comprises a thermal energy source and a thermal energy transfer device, the method comprising:
determining a supply temperature of a fluid;
determining a return temperature of the fluid;
determining a flow rate of the fluid; and
regulating the flow rate of the fluid such as to maintain a target temperature difference between the supply temperature and the return temperature, while ensuring that:
the return temperature is above a minimum return temperature threshold; and
the flow rate is above an operational flow rate threshold of the thermal energy transfer device.

2. The method according to claim 1, further comprising increasing the flow rate if the return temperature is equal to or less than a sum of the minimum return temperature threshold and a temperature safety margin.

3. The method according to claim 2, further comprising closing off a flow regulating device such as to prevent a flow of fluid to and/or from the thermal energy source:
if the flow regulating device is fully open and the return temperature is equal to or less than the sum of the minimum return temperature threshold and the temperature safety margin; and/or
if the flow regulating device is fully open and the flow rate is equal to or less than a sum of the operational flow rate threshold and a flow safety margin; and/or
upon detection of a sudden change of the return temperature, indicative of a malfunction/deactivation of the thermal energy transfer device.

4. The method according to claim 3, further comprising transmitting, by the flow regulating device, a turn-off signal to the thermal energy transfer device if the flow regulating device is fully open and the return temperature is equal to or less than the sum of the minimum return temperature threshold and the temperature safety margin.

5. The method according to claim 3, further comprising transmitting, by the flow regulating device, a turn-off signal to the thermal energy transfer device if the flow regulating device is fully open and the flow rate is equal to or less than the sum of the operational flow rate threshold and the flow safety margin.

6. The method according to claim 1, further comprising increasing the flow rate if the flow rate is equal to or less than a sum of the operational flow rate threshold and a flow safety margin.

7. The method according to claim 1, further comprising:
receiving, by a flow regulating device, a signal indicative of a thermal energy demand of the thermal energy transfer device; and
regulating the flow rate of the fluid further as a function of the thermal energy demand.

8. The method according to claim 7, further comprising increasing the flow rate at one or more predetermined time intervals, in a presence of thermal energy demand.

9. The method according to claim 1, wherein regulating the flow rate of the fluid such as to maintain the target temperature difference comprises:
maintaining the target temperature difference as a function of the supply temperature; or
maximizing a temperature difference; or
maintain a predefined return temperature range.

10. The method according to claim 1, further comprising:
receiving, by a flow regulating device, data indicative of a secondary supply temperature and/or a secondary return temperature of a secondary fluid flowing between the thermal energy transfer device and a thermal energy consumer and regulating the flow rate of the fluid further as a function of the secondary supply temperature and/or the secondary return temperature; and/or
receiving, by the flow regulating device, data indicative of an energy consumption of the thermal energy transfer device and regulating the flow rate of the fluid further as a function of the energy consumption of the thermal energy transfer device; and/or
receiving, by the flow regulating device, data indicative of one or more internal states of the thermal energy transfer device and regulating the flow rate of the fluid further as a function of the one or more internal states of the thermal energy transfer device.

11. A flow regulating device comprising:
a processor configured to carry out the method according to claim 1; and
a valve and/or a damper configured to regulate the flow rate of the fluid between the thermal energy source and the thermal energy transfer device.

12. The flow regulating device according to claim 11, further comprising:
a temperature sensor device configured to determine the supply temperature of the fluid and the return temperature of the fluid; and
a flow rate sensor device configured to determining the flow rate of the fluid to and/or from the thermal energy source and the thermal energy transfer device.

13. The flow regulating device according to claim 12, wherein the temperature sensor device comprises a first temperature sensor configured to determine the supply temperature of the fluid to the thermal energy source and a second temperature sensor configured to determine the return temperature of the fluid from the thermal energy source.

14. The flow regulating device according to claim 11, further comprising or communicatively connected to a secondary temperature sensor device configured to determine a secondary supply temperature and/or a secondary return temperature of a secondary fluid at a secondary fluid circuit of a thermal energy consumer, the flow regulating device being further configured to determine a thermal energy demand of the thermal energy transfer device based on the secondary supply temperature and/or the secondary return temperature.

15. The flow regulating device according to claim 11, further comprising or communicatively connected to a secondary flow rate sensor device configured to determine a secondary flow rate of a secondary fluid at a secondary fluid circuit of a thermal energy consumer, the flow regulating device being further configured to determine a thermal energy demand of the thermal energy transfer device based on the secondary flow rate.

16. An HVAC system comprising:

a thermal energy source;

a thermal energy transfer device; and a fluid transportation system comprising:

a supply fluid transportation line arranged to transport a fluid from the thermal energy source to the thermal energy transfer device;

a return fluid transportation line arranged to transport the fluid from the thermal energy transfer device to the thermal energy source; and a flow regulating device, arranged to regulate a flow rate of the fluid through the fluid transportation system between the thermal energy source and the thermal energy transfer device, wherein the HVAC system is configured to carry out a method comprising:

determining a supply temperature of the fluid;

determining a return temperature of the fluid;

determining the flow rate of the fluid; and regulating the flow rate of the fluid such as to maintain a target temperature difference between the supply temperature and the return temperature, while ensuring that:

the return temperature is above a minimum return temperature threshold; and the flow rate is above an operational flow rate threshold of the thermal energy transfer device.

17. The HVAC system according to claim 16, further comprising a thermal energy consumer fluidly connected with the thermal energy transfer device by a secondary fluid transportation system comprising:

a secondary supply fluid transportation line arranged to transport a secondary fluid from the thermal energy transfer device to the thermal energy consumer; and a secondary return fluid transportation line arranged to transport the secondary fluid from the thermal energy consumer to the thermal energy transfer device.

18. The HVAC system according to claim 16, wherein the thermal energy source is configured to supply and/or extract heat to/from the thermal energy transfer device.

19. The HVAC system according to claim 18, wherein the thermal energy transfer device comprises a secondary thermal energy source configured to supplement the thermal energy provided by the thermal energy source.

20. A non-transitory computer readable medium storing thereon instructions which, when executed by a processor of a flow regulating device, cause the processor of the flow regulating device to carry out the method according to claim 1.

* * * * *